United States Patent [19]

Ramsey

[11] 4,194,096

[45] Mar. 18, 1980

[54] MICROPHONE SHOCK MOUNT AND ASSEMBLY

[75] Inventor: Robert C. Ramsey, Niles, Mich.

[73] Assignee: Electro-Voice, Incorporated, Buchanan, Mich.

[21] Appl. No.: 957,067

[22] Filed: Nov. 3, 1978

[51] Int. Cl.[2] ..... H04R 1/02

[52] U.S. Cl. ..... 179/147

[58] Field of Search ..... 179/146 R, 147, 152

[56] References Cited

U.S. PATENT DOCUMENTS

| | | | |
|---|---|---|---|
| 2,776,462 | 1/1957 | Burroughs | 24/263 R |
| 3,155,780 | 11/1964 | Burroughs | 179/146 R |
| 3,653,625 | 4/1972 | Plice | 179/147 |

*Primary Examiner*—George G. Stellar

*Attorney, Agent, or Firm*—Burmeister, York, Palmatier, Hamby & Jones

[57] ABSTRACT

A shock and vibration isolating mount for a microphone and the assembly of such a mount with a microphone in which the mount has a lower frame mounted on the post of a stand by a swivel. The lower frame is semicylindrical, and it is hinged at one edge to an upper frame also semicylindrical. The upper and lower frames each carry a pair of closed bands of elastomer material under tension, one pair of bands extending transversely around the lower frame in spaced relation and the other pair of bands extending transversely around the upper frame in spaced relation. The microphone is disposed between the upper and lower frames and between the first pair of bands and the second pair of bands, and the frames are provided with a latch mechanism at their edges opposite the hinge to prevent the frames from opening from a closed position to an open position except when the microphone is to be removed from the mount. The mass of the microphone and the compliance of the bands forms a mechanical moving system with a resonance below the frequency range of the microphone.

10 Claims, 19 Drawing Figures

FIG. 9
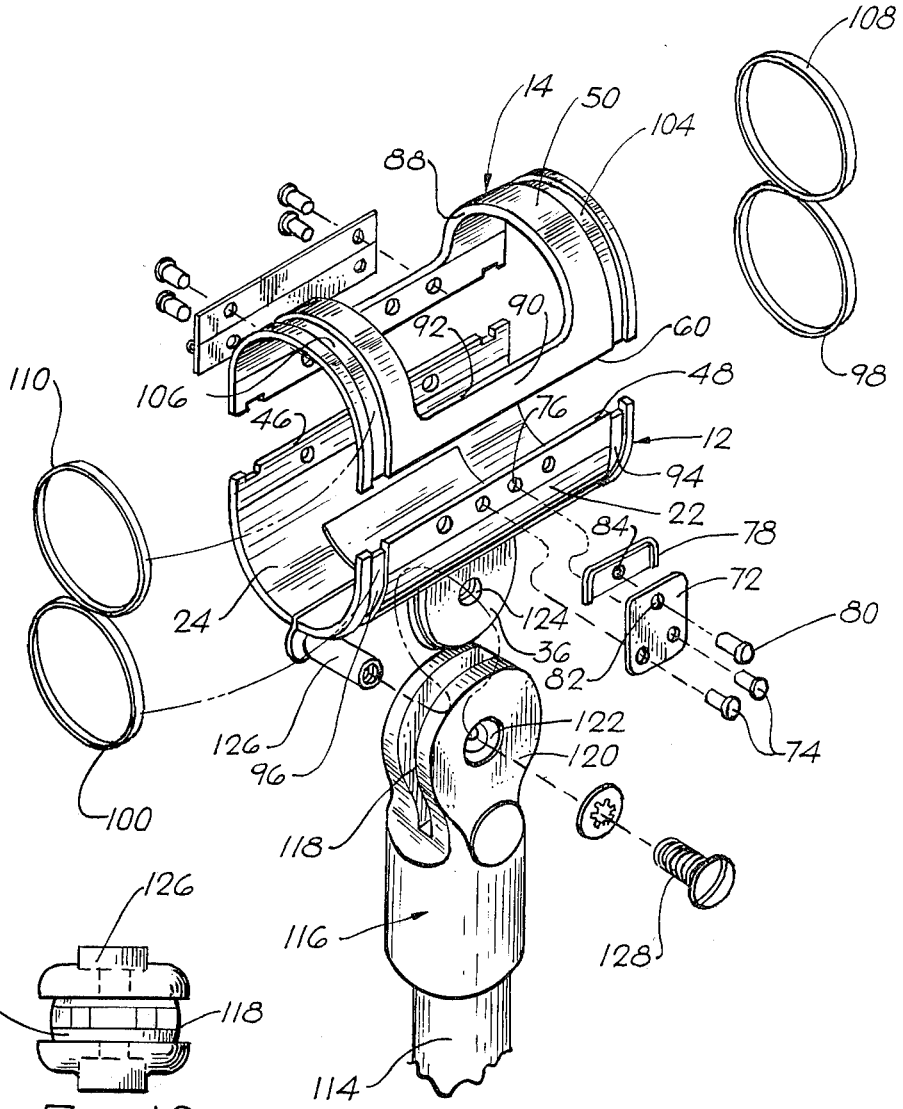
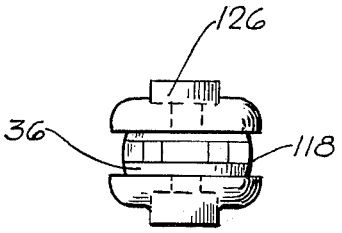
FIG. 10
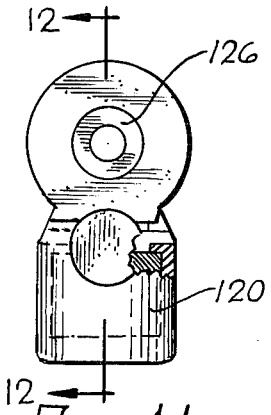
FIG. 11
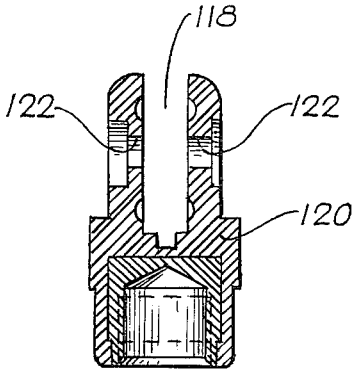
FIG. 12

MICROPHONE SHOCK MOUNT AND ASSEMBLY

The present invention relates to means for mounting a microphone and to an assembly of a microphone and a mounting device attached to the microphone.

Many performers and speakers find it desirable to use a microphone stand during their performance, and it is often desirable for the performer or speaker to hand hold the microphone at certain times during the same performance. As a result, the performer desires to be able to remove the microphone from a microphone stand or to replace the microphone at will, and further, to use a microphone which is not encumbered with mounting structure when hand held.

For many years, microphone stands were provided with a U-shaped clamp which permitted the microphone to be removed from the stand or placed on the stand by the speaker or performer at will. U.S. Pat. No. 2,776,462 to Burroughs entitled MICROPHONE CLAMP is an example of such a structure. Such microphone clamps however could only be used with microphones designed for use with that particular clamp, since microphones of other sizes could not be engaged by the clamp. Further, stands employing such clamps tended to transmit shock and vibration from the stand to the microphone itself. Such shocks and vibrations will cause movement of air relative to the microphone, and hence an electrical pickup from the microphone.

U.S. Pat. No. 3,155,780 to Burroughs entitled MICROPHONE AND MOUNTING MEANS ASSEMBLY discloses a microphone mounting structure using elastomer bands between the stand and the microphone itself in which the compliance of the bands forms a mechanical resonance with the mass of the microphone which is below the audible frequency range of the microphone. As a result of this, structure shocks and vibrations from the stand to the microphone tend to be isolated from the microphone, except for frequencies below the audible range. The microphone clamp of U.S. Pat. No. 3,155,780, however, could not readily be removed from the stand or placed upon the stand.

Mr. Gerald W. Plice described a microphone accessory shock mount for stand or boom use in an article appearing in the February 1971 issue of *The Journal of the Audio Engineering Society,* Volume 19, No. 2, pages 133 through 137, in which a plastic frame is utilized to support a hollow rubber "donut" and the microphone is disposed in a channel in the interior of the donut. The author describes the mount as providing isolation from shock for both boom use and floor or desk stand use, but the microphone may not be removed from the donut mount without electrically disconnecting the microphone, which may be objectionable to the speaker or performer. Such microphones are often disconnected from a stand by providing a disconnecting adapter between the shock mount and the stand, but the shock mount remains with the microphone during hand use in such arrangements.

It is an object of the present invention to provide a microphone mounting device which may be used with a floor stand, desk stand, or a boom, which will isolate the microphone from shock and vibration carried by the stand or boom, and which will permit removal of the microphone for hand held use without disconnecting the microphone from its electrical cord and without the necessity of carrying any part of the mounting assembly with the microphone during hand held use.

It is also an object of the present invention to provide a mounting device for the microphone which may be used with microphones having widely varying external dimensions, and particularly such a mounting device which will achieve isolation from shock and vibration carried by any stand the device is mounted on and which will permit removal of the microphone during use without the necessity of electrically disconnecting the microphone from its cord or carrying portions of the mounting structure with the microphone during hand held use.

Further objects and advantages of the present invention will be apparent from the following description of a preferred embodiment of the invention, which is shown in the drawings, as follows.

Figure 1:
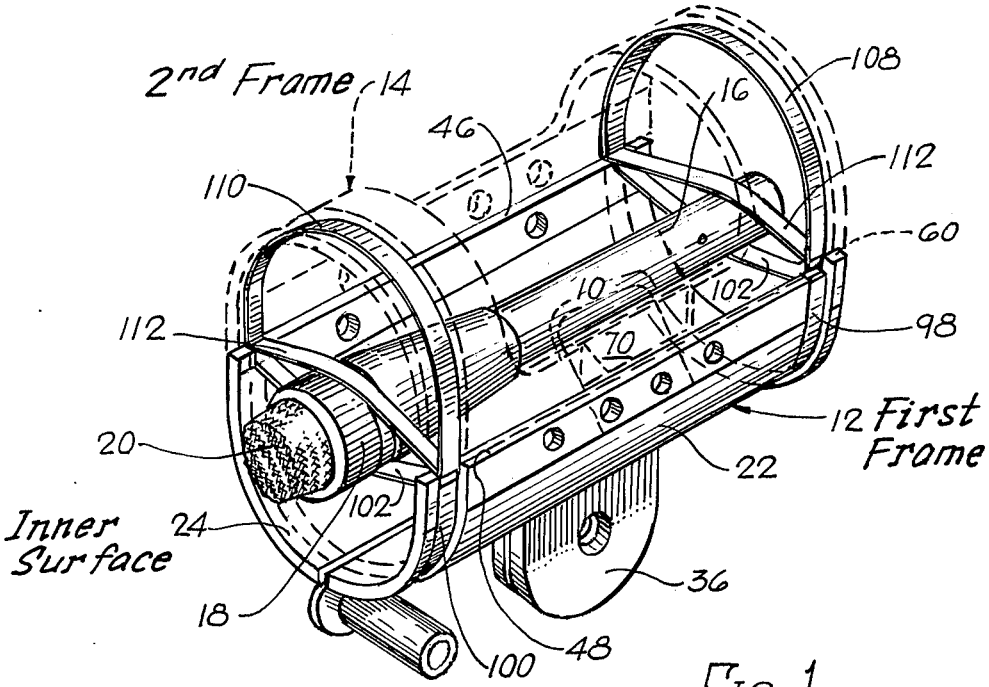
FIG. 1 is an isometric view of an assembly of a microphone and device for mounting the microphone constructed according to the teachings of the present invention.
Figure 3:
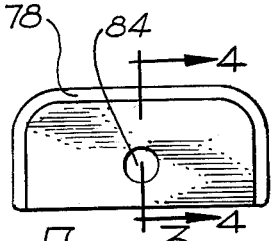
FIG. 2 and FIG. 3 are front elevational views of the latch illustrated in FIG. 1.
Figure 4:
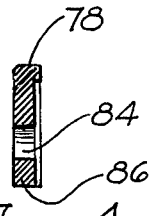
Figure 2:
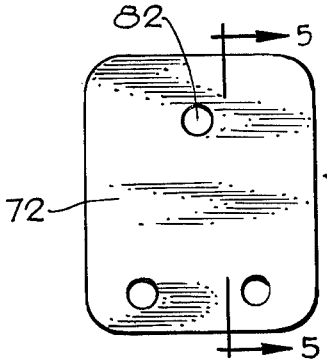
Figure 5:
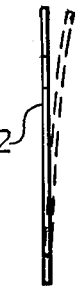
Figure 7:
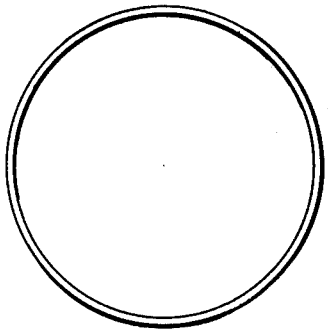
Figure 8:
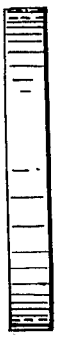
Figure 6:
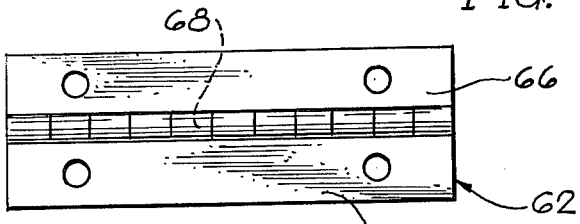
Figure 17:
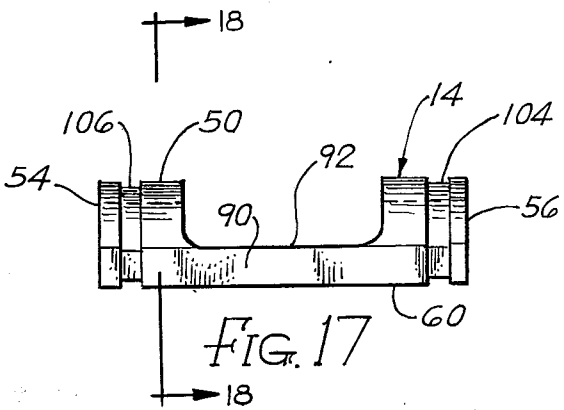
Figure 19:
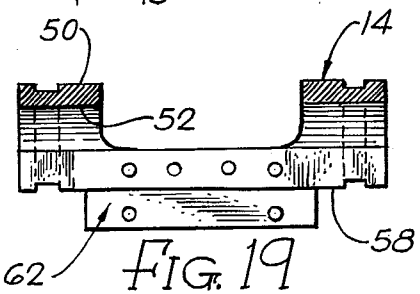
Figure 18:
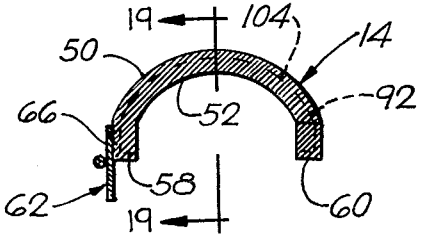
Figure 14:
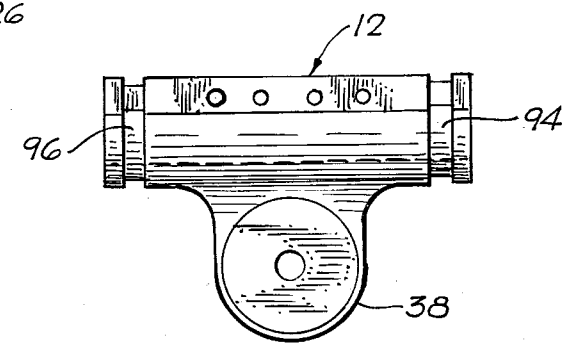
Figure 16:
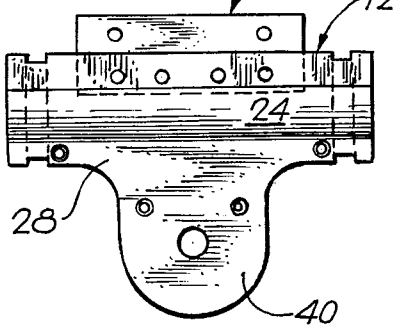

FIGS. 4 and 5 are sectional views of the latch taken along the line 4—4 of FIG. 3 and 5—5 of FIG. 2, respectively;

FIG. 6 is a rear elevational view of the hinge illustrated in FIG. 1;

FIGS. 7 and 8 are side and front elevational views of one of the bands illustrated in FIG. 1;

FIG. 9 is a broken away isometric view of the microphone mounting device constructed according to the teachings of the present invention;

FIGS. 10, 11 and 12 are top elevation, front elevation, and transverse sectional views, respectively, of one portion of the swivel illustrated in FIG. 9;

FIGS. 13, 14, 15 and 16 are top plan, side elevation, transverse section, and rear elevational views of the lower portion of the frame illustrated in FIG. 9; and FIGS. 17, 18 and 19 are front elevation, transverse section and longitudinal section views of the upper frame member illustrated in FIG. 9, respectively, the sectional views being taken along the lines 18—18 and 19—19 illustrated in FIGS. 17 and 18, respectively.

As illustrated in FIG. 1, a typical microphone 10 is shown mounted between a first frame 12 and a second frame 14, the second frame being shown in dashed lines to permit a viewing of the microphone itself. It will be noted that the microphone has an elongated barrel 16 which supports a head 18 at one end, and a screen 20 protrudes from the head 18. The barrel 16 in the particular microphone is cylindrical, but the present invention may be practiced with microphones having variations in shape from that illustrated.

Figure 13:
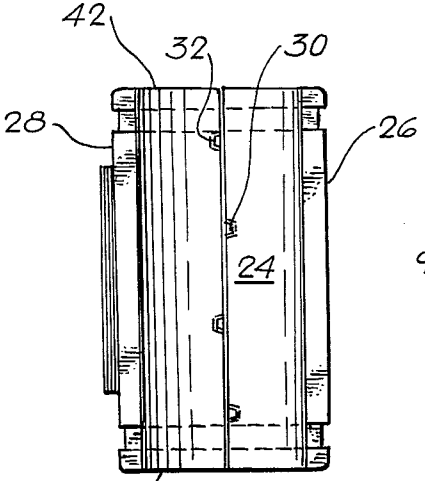
Figure 15:
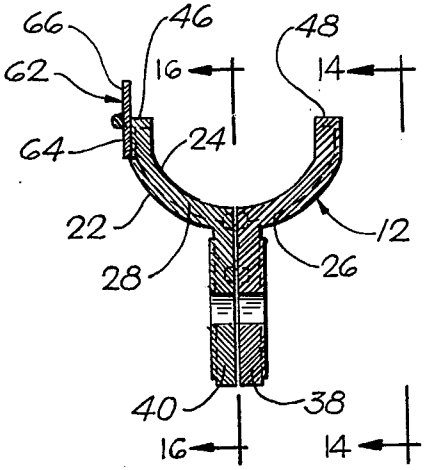

The lower frame 12 also shown in FIGS. 13 through 16 is semicylindrical and has an outer surface 22 and an inner surface 24. For ease of fabrication, the lower frame 12 is constructed of two separate parts 26 and 28, as best illustrated in FIGS. 13 and 15, and the parts are provided with mating protrusions 30 and recesses 32 to achieve a fixed alignment and to provide a continuous inner surface 24, as illustrated in FIG. 13. Further, the lower frame is provided with a protruding tab 36 which is formed by a pair of mating tabs 38 and 40 which extend outwardly from the surface 22. The lower frame 12 has ends 42 and 44 which extend perpendicular to the axis of revolution of the surfaces 22 and 24. In addition, the edges 46 and 48 which extend between the surfaces 22 and 24 are flat and parallel to the axis of revolution of surfaces 22 and 24.

The upper frame 14 also shown in FIGS. 17 through 19 is also semicylindrical, and has a semicylindrical outer surface 50 and semicylindrical inner surface 52. The ends 54 and 56 of the upper frame 14 are also perpendicular to the axis of the revolution of the surfaces 50 and 52 and spaced by the same distances as the ends 42 and 44 of the lower frame 12. In addition, the edges 58 and 60 which extend between the surfaces 50 and 52 of the upper frame 14 are also flat and parallel to the axis of revolution of the surfaces 50 and 52. A hinge 62 shown in FIGS. 6 and 9 is mounted between the lower frame 12 and the upper frame 14 to provide a pivotal mounting. The hinge has a pair of leaves 64 and 66 which are pivotally mounted to each other by a pin 68, and the one leaf 64 is mounted on the lower frame 12 with the pin aligned with the edge 46 thereof. The other leaf 66 is mounted on the upper frame 14 adjacent to the edge 58, with the pin 68 disposed confronting the edge 58. In this manner, the upper frame 14 may be pivoted with respect to the lower frame between two positions, one position in which the edges 48 of the lower frame and 60 of the upper frame are in abutment and the other position in which these edges are remote from each other.

The mounting assembly is provided with a latch 70 best illustrated in FIGS. 1 through 5 and 9. The latch has a flat plate 72 which is constructed of resilient material, and may be bent as illustrated by the dashed lines in FIG. 5. The plate 72 is secured on the lower frame 12 centrally and adjacent to the edge 48 by means of a pair of rivets 74 which extend through apertures 76. The plate 72 carries at its upper end a latch member 78 which is secured thereto by a rivet 80 extending through apertures 82 and 84 in the plate 72 and latch member 78. The latch member has a flat lower surface 86 shown in FIG. 4 which extends toward the upper frame 14 and is spaced upwardly from the edge 48 of the lower frame 12. The upper frame is provided with a cutout 88 which provides a narrow strip 90 adjacent to the edge 60 thereof, and the strip 90 has a flat surface 92 disposed parallel to the surface of the edge 60 and spaced therefrom by a distance slightly less than the distance that the shoulder 86 of the latch member 70 extends above the edge 48 of the lower frame 12. The surface 86 of the latch member extends into abutment with the surface 92 of the upper frame 14 and is held in this position by the resiliency of the plate 72, thereby latching the upper frame 14 with respect to the lower frame 12 in the one pivotal position. The upper frame 14 may be pivoted with respect to the lower frame 12 by manually bending the plate 72 away from the upper frame 14 to translate the surface 86 of the latch member away from the surface 92 of the upper frame 14, thus permitting the upper frame to be pivoted on the hinge 62.

The lower frame 12 is provided with two spaced flat grooves 94 and 96 which extend about the surface 22 parallel to the ends 42 and 44. A pair of flat bands 98 and 100 are disposed in the grooves 94 and 96 and extend about the lower frame 12. The bands are of elastomeric material, such as rubber or plastic, urethane of forty-five durometer having been found satisfactory. The bands 98 and 100 are stretched under tension, and not only extend about the grooves 96 in the exterior surface 22 of the lower frame 12, but a portion of the bands designated 102 in FIG. 1 extends between the edges 48 and 46, thus confronting the inner surface 24. The grooves 94 and 96 function to retain the bands 98 and 100 in position on the lower frame 12.

In like manner the upper frame 14 is provided with two spaced grooves 104 and 106 in the outer surface 50 thereof. The grooves 104 and 106 are spaced from each other by the same distance as the grooves 94 and 96 and are aligned therewith. The grooves 104 and 106 are flat, and accommodate a pair of elastomeric bands 108 and 110 which are identical to the bands 98 and 100 are are illustrated in FIGS. 7 and 8. The bands 108 and 110 are under tension and extend about the upper frame 14 in the grooves 104 and 106 and across the edges 58 and 60 to confront the surface 52, the portion of the bands 108 and 110 confronting the surface 52 being designated 112 in FIG. 1.

As illustrated in FIG. 1, the microphone 10 is disposed between the portions 102 of the bands 98 and 100 and the portions 112 of the bands 108 and 110. The material of the bands 98, 100, 108 and 110 adheres to the surface of the microphone 10 and holds it in position without the need of adhesives or the like due to the nature of the material and the fact that the bands are under tension. The microphone 10 further stretches the bands and increases the tension. The bands are highly compliant and form a moving system with the microphone with a mechanical resonance determined by the compliance of the bands and the mass of the microphone 10. The bands 98, 100, 108 and 110 are selected to have a compliance which will achieve a mechanical resonance with the mass of microphone 10 below the frequency response range of the microphone, thus isolating the microphone from shocks and vibrations which are apt to be transmitted to the microphone from its mounting stand. In practice, a mechanical resonance for the moving system consisting of the bands 98, 100, 108 and 110 and the microphone 10 below 100 Hz. is satisfactory.

As best shown in FIGS. 9 through 12 lower frame 12 is mounted on a stand post 114 by means of a swivel coupler 116. The swivel coupler 116 includes the tab 36 which protrudes outwardly from the lower frame 12 and mates with the slot 118 in a bifurcated member 120. The bifurcated member and tab 36 are provided with apertures 122 and 124 respectively, and a threaded hollow sleeve 126 extends through the apertures 122 and 124. A screw 128 threadedly engages the internal threads of the sleeve 126 to lock the bifurcated member 120 in position on the tab 36.

From the foregoing description of the present invention, those skilled in the art will devise many constructions contemplated by the invention and uses for the invention over and above that set forth in this specification. It is therefore intended that the scope of the present invention be not limited by the foregoing specification, but rather only by the appended claims.

The invention claimed is:

1. A device for mounting a microphone comprising a first frame and a second frame, each of the frames having a first surface extending between opposite ends thereof, each first surface having an elongated recess extending therein between the opposite ends thereof, and each of the frames having a second surface extending between the opposite ends thereof opposite the first surface, two position means for mounting the first frame on the second frame in a first position or a second position, the first surface of the first frame being in abutment with the first surface of the second frame and the elongated recesses of the first and second frames being aligned to form a channel in the first position, and the first surface of the first frame being remote from the first surface of the second frame in the second position, a first and a second closed band of elastomeric material extending about the first frame, one of said first and second bands being disposed adjacent to each end of the first frame and in abutment with the first and second surfaces of the first frame, a third and a fourth closed band of elastomeric material extending about the second frame in spaced relationship, one of said third and fourth bands being disposed adjacent to each end of the second frame and in abutment with the first and second surfaces of the second frame, whereby a microphone may be placed between the portion of the first and second bands confronting the first surface of the first frame and the portion of the third and fourth bands confronting the first surface of the second frame with the mounting means in the second position and the mounting means changed to the first position to secure the microphone on the bands, the microphone being accommodated in the channel in said first mounting position.

2. A device for mounting a microphone comprising the combination of claim 1 wherein the two position means for mounting the first frame on the second frame comprises a hinge having a first leaf mounted on the second surface of the first frame adjacent to one edge of the first surface thereof and a second leaf mounted on the second surface of the second frame adjacent to one edge of the first surface thereof.

3. A device for mounting a microphone comprising the combination of claim 2 wherein the two position means for mounting the first frame on the second frame includes a latch having a first part mounted on the second surface of the first frame adjacent to the edge of the first surface thereof opposite the hinge, and a second releasably mating part mounted on the second surface of the second frame adjacent to the edge of the first surface thereof opposite the hinge.

4. A device for mounting a microphone comprising the combination of claim 1 wherein the first and second frames comprise semicylindrical members of the same radius of curvature, the first surfaces of each frame being the concave inner surface and the second surfaces of each frame being the convex outer surfaces, the second surfaces of each frame having a groove extending across the second surface from the first surface adjacent to each end and disposed in a plane normal to the axis of the member, and one of the bands being disposed in each of the grooves.

5. A device for mounting a microphone comprising the combination of claim 4 wherein the second frame is provided with a cutout between and spaced from the grooves thereof, said cutout forming a flat surface parallel to the edge of the second frame opposite the hinge, in combination with a flat plate mounted on the second surface of the first frame adjacent to and extending beyond the edge thereof opposite the hinge, said plate having a lip protruding therefrom toward the axis of the first frame provided with a flat surface confronting and spaced from the second frame, said flat surface of the lip engaging the flat surface formed by the cutout of the second frame when the means for mounting the first frame on the second frame is in the first position to form a latch.

6. A device for mounting a microphone comprising the combination of claim 1 in combination with a post and a swivel coupler having a first part mounted on the post and a second part mounted on the second surface of the first frame.

7. An assembly comprising a device for mounting a microphone constructed according to claim 1 in combination with a microphone having response range and a mass disposed in the channel between the first surfaces of the first and second frames and in abutment with the portions of the first, second, third and fourth bands confronting said first surfaces, the bands being stretched and forming a compliant mounting for the microphone, and the compliance of the mounting and the mass of the microphone producing a mounting with mechanical resonance below the response range of the microphone.

8. A device for mounting a microphone comprising a first frame having a part cylindrical outer surface and a pair of ends normal to the axis thereof, said first frame having a part cylindrical inner surface extending between the ends thereof coaxial with the outer surface and flat edges extending between the inner surface end and the outer surface thereof parallel to the axis of the first frame, a second frame having a part cylindrical outer surface and a pair of ends normal to the axis thereof, said second frame having a part cylindrical inner surface extending between the ends thereof coaxial with the outer surface and flat edges extending between the inner surface and the outer surface thereof parallel to the axis of the second frame, a hinge having a first leaf and a second leaf pivotally mounted on each other along an axis, the first leaf being mounted on the outer surface of the first frame with the pivotal axis of the hinge adjacent to one edge of the first frame, the second leaf being mounted on the outer surface of the second frame with the pivotal axis of the hinge adjacent to one edge of the second frame, the second frame being pivotal with respect to the first frame on said hinge between a first position in which the edges of the first and second frames opposite the hinge abut and a second position in which said edges are spaced from each other, a first pair of bands of elastomeric material, each band of the first pair being stretched about the first frame parallel to and adjacent to one end of the first frame, a second pair of bands of elastomeric material, each band of said second pair being stretched about the second frame parallel to and adjacent to one end of the second frame, and a releasable latch mounted on one of the frames and engaging the other frame to retain the frames in the first position.

9. A device for mounting a microphone comprising the combination of claim 8 in combination with a swivel having a tab protruding from a central portion of the outer surface of the first frame, a connector adapted to engage the post of a stand, said connector having two parallel spaced bifurcations accommodating the tab between the bifurcations thereof, the tab and connector having aligned apertures, and a pin extending through the apertures of the tab and connector.

10. An assembly comprising a device for mounting a microphone constructed according to claim 8 in combination with a microphone having a mass disposed within the inner surfaces of the first and second frame between the first pair of bands and the second pair of bands, the bands forming a compliant mounting for the microphone, and the mas of the microphone and compliance of the mounting resulting in a mechanical resonance for the microphone and bands below 100 Hz.

* * * * *